US011607054B1

(12) United States Patent
Roe

(10) Patent No.: US 11,607,054 B1
(45) Date of Patent: Mar. 21, 2023

(54) AUTOMATED BED-MAKING APPARATUS AND METHOD

(71) Applicant: Buhm Jung Roe, New York, NY (US)

(72) Inventor: Buhm Jung Roe, New York, NY (US)

( * ) Notice: Subject to any disclaimer, the term of this patent is extended or adjusted under 35 U.S.C. 154(b) by 0 days.

(21) Appl. No.: 17/886,113

(22) Filed: Aug. 11, 2022

(51) Int. Cl.
*A47C 21/02* (2006.01)

(52) U.S. Cl.
CPC ..... *A47C 21/028* (2013.01)

(58) Field of Classification Search
CPC ..... A47C 21/028; A61G 7/1069
USPC ..... 5/488
See application file for complete search history.

(56) References Cited

U.S. PATENT DOCUMENTS

| | | | | |
|---|---|---|---|---|
| 352,497 | A * | 11/1886 | Street et al. | A47C 21/022 24/72.5 |
| 427,533 | A * | 5/1890 | Arnold | A47C 21/028 5/488 |
| 525,029 | A * | 8/1894 | Reilly | A47C 21/022 24/72.5 |
| 682,617 | A * | 9/1901 | Herbs | A47C 21/028 5/488 |
| 1,214,090 | A * | 1/1917 | Spaulding | A47C 21/00 5/506.1 |
| 6,481,585 | B1 | 11/2002 | Cloughton | |
| 11,179,284 | B2 * | 11/2021 | Stocker | A61G 7/0536 |
| 2006/0215355 | A1 * | 9/2006 | Russell | A47G 9/0261 361/600 |
| 2010/0115699 | A1 | 5/2010 | Van Houte | |
| 2011/0119827 | A1 * | 5/2011 | Berruti | A47C 21/028 5/488 |

FOREIGN PATENT DOCUMENTS

| | | | | |
|---|---|---|---|---|
| CN | 112056858 | | 12/2020 | |
| EP | 1090569 | A1 * | 4/2001 | A47C 21/028 |
| FR | 2790195 | A1 * | 9/2000 | A47C 21/022 |
| JP | 2012235877 | | 12/2012 | |

(Continued)

OTHER PUBLICATIONS

OHEA Smart Bed automatically makes itself in under a minute; https://www.startupselfie.net/2018/03/20/ohea-smart-bed-automatically-makes-itself/, Mar. 20, 2018.

*Primary Examiner* — Myles A Throop
(74) *Attorney, Agent, or Firm* — Lawrence B. Goodwin, PLLC

(57) ABSTRACT

An apparatus and a method for automatically making a bed includes a sheet holder suspended from a sheet holder support, a head-end duvet cover holder suspended from a head-end duvet cover holder support, a foot-end duvet cover holder suspended from a foot-end duvet cover holder support, a duvet holder suspended from a duvet holder support, a plurality of connectors on each of the sheet holder, the head-end duvet cover holder, the foot-end duvet cover holder, and the duvet holder, the connectors adapted to be connected to mating connectors on a sheet, a head-end of a duvet cover, a foot end of the duvet cover, and a duvet, respectively, and a framework upon which the sheet holder support, the head-end duvet cover holder support, the foot-end duvet cover holder support, and the duvet holder support are mounted. A sheet, duvet and duvet cover are manually attached to the holders, the duvet is automatically inserted into the duvet cover, and the sheet and the duvet are draped over the bed.

17 Claims, 17 Drawing Sheets

FIG. 3A

(56) References Cited

FOREIGN PATENT DOCUMENTS

| | | | | |
|---|---|---|---|---|
| JP | 2014200648 | | 10/2014 | |
| WO | WO2006/011794 | | 2/2006 | |
| WO | WO-2006011794 | A1 * | 2/2006 | ..... A47G 9/0261 |
| WO | WO2009/109898 | | 9/2009 | |

* cited by examiner

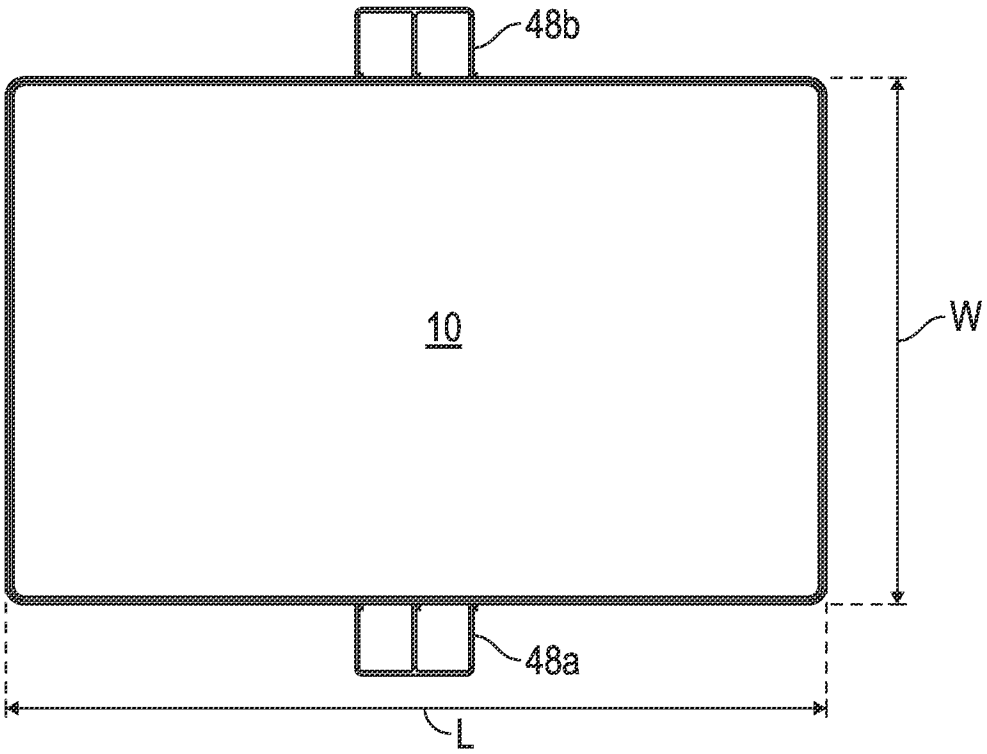
FIG. 1A
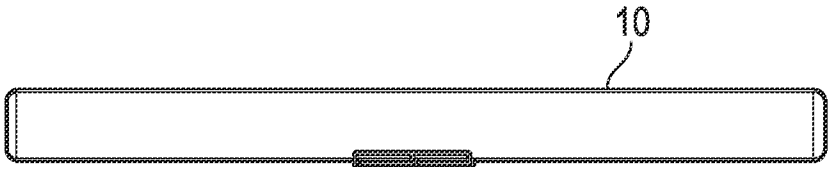
FIG. 1B
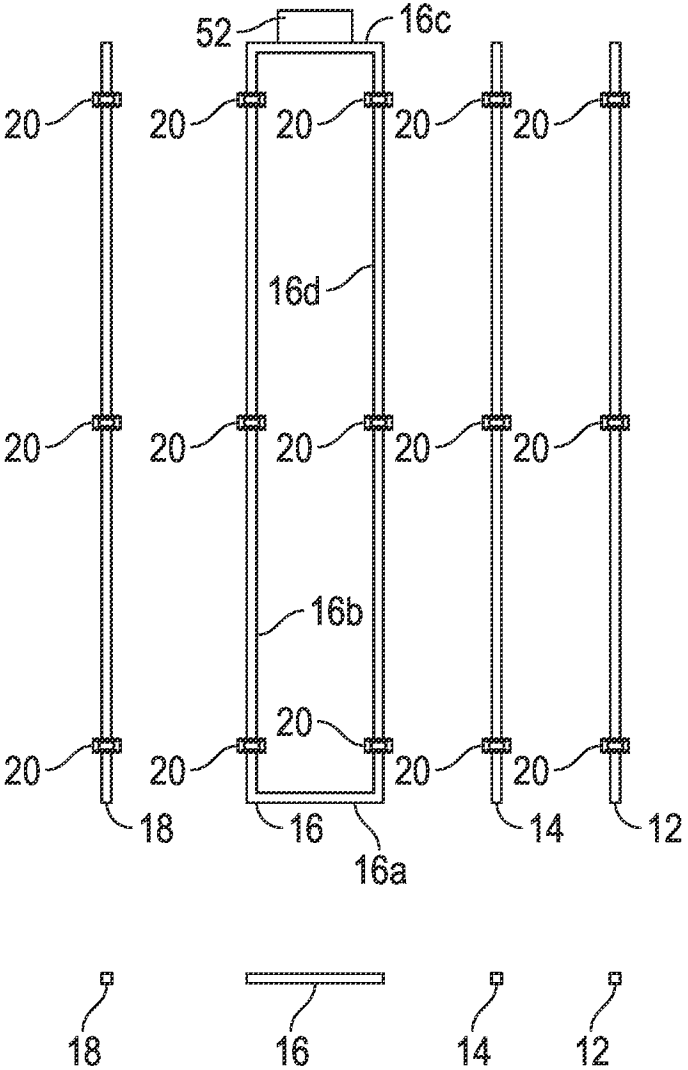

AUTOMATED BED-MAKING APPARATUS AND METHOD

FIELD OF THE INVENTION

The present invention is directed to an apparatus and method for automating the making of a bed.

BACKGROUND OF THE INVENTION

In the hotel and hospitality industries, in hospitals, and in senior center facilities, bed-making is a necessary, repetitive, time-consuming chore that must be performed daily by service staff, requiring substantial service personnel time, attention, physical presence, and human labor. It requires service personnel to remove used sheets and pillow cases, remove the comforter or duvet from the bed, remove the duvet or comforter from its cover, apply a fresh sheet to the bed, insert the duvet into a fresh cover and apply it to the bed, and insert the pillows into fresh cases and apply them to the bed. It is important that the application of the sheet and duvet onto the bed be done carefully to ensure a neat, clean and aesthetic appearance.

Thus, bed-making is labor-intensive and adds significant expense to the service and operation of a hotel, hospital or senior center, particularly in large venues, where many hundreds of rooms may need to be serviced daily. Moreover, each service person's time must be devoted to this task, diverting service persons from other important tasks which could otherwise be used more effectively.

Accordingly, the present invention, as described and claimed below, can save a tremendous amount of labor and thus can save a significant amount of money for hotels, hospitals and senior centers.

SUMMARY OF THE INVENTION

In accordance with one example of the present invention, apparatus for automatically making a bed includes a sheet holder suspended from a sheet holder support, a head-end duvet cover holder suspended from a head-end duvet cover holder support, a foot-end duvet cover holder suspended from a foot-end duvet cover holder support, a duvet holder suspended from a duvet holder support, a plurality of connectors on each of the sheet holder, the head-end duvet cover holder, the foot-end duvet cover holder, and the duvet holder, the connectors adapted to be connected to mating connectors on a sheet, a head-end of a duvet cover, a foot end of the duvet cover, and a duvet, respectively, and a framework upon which the sheet holder support, the head-end duvet cover holder support, the foot-end duvet cover holder support, and the duvet holder support are mounted. At least the sheet holder support and the duvet holder support are adapted to selectively raise and lower the sheet and duvet, respectively. The framework may be comprised of a track mounted on a ceiling in a room in which the bed is located, and at least the sheet holder support and the head-end duvet cover holder support are adapted to move along the track.

The sheet holder, the head-end duvet cover holder and the duvet holder are preferably comprised of rods, the foot-end duvet cover holder is preferably formed of a plurality of rods to thereby define an opening, and each of the rods may be formed of metal, plastic or wood. At least the sheet holder support and the duvet holder support include pullies from which the sheet holder and duvet holder are suspended, respectively, to thereby raise and lower the sheet and duvet upon rotation of the pullies. The connectors are preferably electrically or electronically controlled. The head-end duvet cover holder support and the foot-end duvet cover holder support are adapted to selectively raise and lower the head-end duvet cover and the foot-end duvet cover, and at least one of the foot-end duvet cover holder support and the duvet cover support are adapted to move on the framework relative to the other such that the opening can be positioned underneath an end of the duvet. Preferably, guides are attached to the foot-end duvet cover holder and may be engaged to facilitate the insertion of the duvet into the duvet cover.

The head-end duvet cover holder support and the foot-end duvet cover holder support may include pullies from which the head-end duvet cover holder and the foot-end duvet cover holder are suspended, respectively, to thereby raise and lower the head-end and foot-end of the duvet upon rotation of the pullies. Gripping panels are preferably provided on sides of the bed and are adapted to selectively grip the sheet against the sides and release the sheet from the sides. A vibratory transducer is preferably attached to the duvet cover holder to facilitate the insertion of the duvet into the duvet cover.

In accordance with another example of the present invention, method for automatically making a bed includes the steps of manually attaching a sheet to a sheet holder suspended from a sheet holder support, automatically raising the sheet holder and the sheet, automatically moving the sheet holder and the sheet over the bed, and automatically releasing the sheet from the sheet holder to thereby drape the sheet over the bed. The method may further include automatically lowering the sheet holder and the sheet after initially raising the sheet holder and sheet, and automatically raising the sheet holder and the sheet after lowering the sheet holder and sheet, to thereby remove wrinkles from the sheet. The method may also include the steps of manually attaching a head-end of a duvet cover to a head-end duvet cover holder suspended from a head-end duvet cover holder support, manually attaching a foot-end of a duvet cover to a foot-end duvet cover holder suspended from a foot-end duvet cover holder support, manually attaching a duvet to a duvet holder suspended from a duvet holder support, automatically raising the duvet and duvet holder, automatically moving at least one of the duvet and the foot end of the duvet cover to place the duvet over the foot-end of the duvet cover, automatically inserting the duvet into the duvet cover, automatically moving the duvet cover and duvet over the bed, and automatically releasing the duvet cover and duvet from the duvet holder and the foot-end duvet cover holder to thereby drape the duvet and foot-end duvet cover over the bed.

The method may further include the steps of automatically releasing the duvet cover from the head-end duvet cover holder to thereby drape the duvet and head-end duvet cover over the bed, and automatically moving the head-end of the duvet cover a predetermined distance back in the direction of the foot-end of the duvet cover, and then releasing the head-end of the duvet cover to thereby drape the head-end of the duvet cover on the bed allowing space for placement of pillows. In accordance with preferred embodiments, the method may include the steps of automatically raising the foot-end of the duvet cover, then lowering the foot-end of the duvet cover, prior to the step of automatically inserting the duvet into the duvet cover, to thereby remove wrinkles from the duvet cover. The step of automatically inserting the duvet into the duvet cover may include the steps of intermittently raising the foot-end of the duvet cover, then lowering the duvet, to thereby partially insert the duvet into the duvet cover, and repeating the steps of intermittently raising the foot-end of the duvet cover, then lowering the duvet, until the duvet is completely inserted into the duvet cover. Preferably, a vibratory transducer attached to the foot-end duvet cover holder is actuated during the step of inserting the duvet into the duvet cover.

BRIEF DESCRIPTION OF THE DRAWINGS

These and other objects and aspects of the present invention will be described with reference to the following drawing figures, of which:

FIG. 1A is a plan view of the automated bed-making apparatus, in relation to a bed, in accordance with an example of the present invention;

FIG. 1B is a front view of a portion of the automated bed-making apparatus, in relation to a bed, in accordance with an example of the present invention;

DETAILED DESCRIPTION

Figure 2:
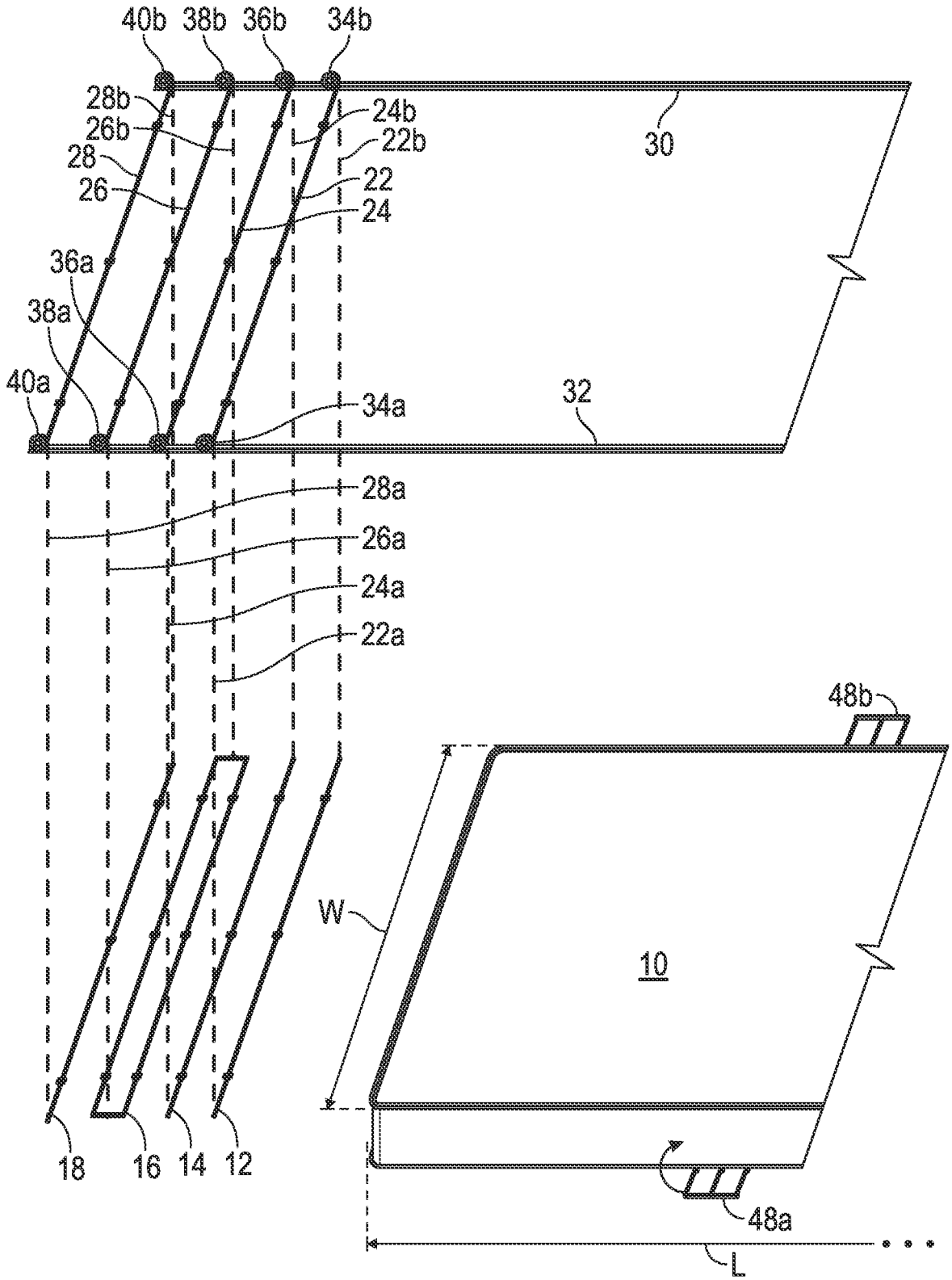
FIG. 2 is a perspective view of the automated bed-making apparatus, in relation to a bed, in accordance with an example of the present invention.

With first reference to FIGS. 1A, 1B and 2, the bed-making apparatus is shown next to bed 10, having width W and length L. The apparatus includes sheet holder 12, head-end duvet cover holder 14, foot-end duvet cover holder 16, and duvet holder 18. (As used herein, "duvet" and "comforter" are used interchangeably.) Holders 12, 14 and 18 are formed of a single rod made of reasonably rigid material, such as lightweight metal, plastic or wood, whereas holder 16 is a generally rectangular framework formed of four such rods, 16*a-d*. The rods 16*a-d* may be formed of individual pieces securely connected to each other, or as a single unitary structure. The dimensions of the holders are preferably sufficient to hold substantially the full extents of the sheet, duvet and duvet cover, in the direction of the bed-width, as will be described, and the opening of the rectangular framework for the foot-end duvet cover holder 16 should be sufficient to accommodate the thickness of the duvet.

As will be described, each of the holders 12, 14, 16 and 18 is preferably provided with electromechanical connectors 20, the locations of which best shown in FIG. 1A. The connectors allow the manual connection of the sheet, duvet cover and duvet to the holders, and the automatic release of the sheet, duvet cover and duvet from the connectors, as will be described. The holders 12, 14 and 18 each have three connectors—one near the middle and two near each end of the rods, whereas holder 16 has six, three on each of rods 16*b* and 16*d*, one near the middle and two near each end of the rods. Each of the connectors 20 can be individually controlled, either wirelessly or through a wired connection, in a routine manner, to release the sheet, cover and duvet when called to do so, as will be described.

As shown in FIG. 2, each of the holders 12, 14, 16 and 18 is suspended from an associated one of upper support rods 22, 24, 26 and 28, respectively, by cable pairs 22*a/b*, 24*a/b*, 26*a/b* and 28*a/b*, which are wrapped around associated pulleys 34*a/b*, 36*a/b*, 38*a/b* and 40*a/b*, respectively. The pulleys 34*a/b*, 36*a/b*, 38*a/b* and 40*a/b* are mounted on the ends of the upper support rods 22, 24, 26 and 28, respectively. The upper support rods are connected to motors (not shown) that individually rotate the support rods and associated pulleys, as will be described below. Additionally, the support rods 22, 24, 26 and 28 are mounted on a framework having parallel tracks 30 and 32 and can move laterally and independently on the tracks, along the direction of the bed length, as will be described. Thus, the holders 12, 14, 16 and 18 can individually be moved vertically, and horizontally in the direction of the bed length. The tracks 30 and 32 can be mounted on the ceiling or recessed into the ceiling, if desired, as long as they are mounted to allow the functions as will be described.

Figures 3, 3A:
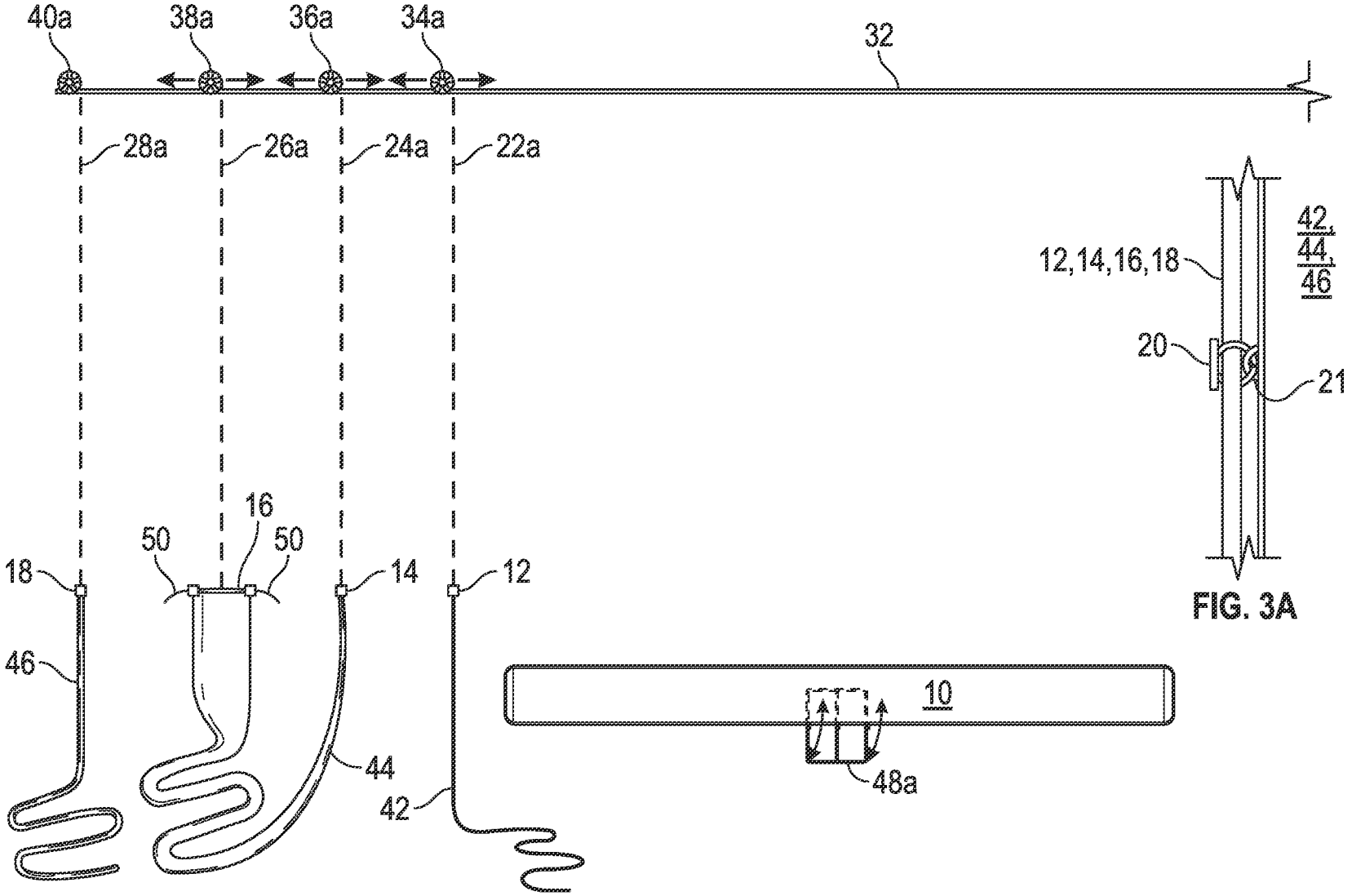
FIGS. 3-17 illustrate an example of the step-by-step method implemented by an example of the apparatus in accordance with the present invention for automatically applying a fresh sheet to the bed, inserting a duvet into a fresh duvet cover, and applying the duvet and cover to the bed.

The operation of the bed-making apparatus will be explained with reference to FIGS. 3-17, where a fresh sheet 42, a fresh duvet cover 44 and a duvet 46 are shown. One edge of the sheet 42, the head-end and foot-end of the duvet cover 44, and an edge of the duvet 46 are provided with mating connectors 21 that are releasably connected to associated ones of the connectors 20 on the holders 12, 14, 16 and 18. An example of a connector 21 is shown in FIG. 3A. The particular type of mating connectors 20/21 on the holders, sheet, duvet cover and duvet can be selected as desired provided they allow for the manual application, and the automatic electronic or electromechanical release of the sheet, duvet cover and duvet from the respective holders at the appropriate time in response to a wired or wireless signal. The edge of the sheet 42, the head-end of the duvet cover 44, and the duvet are each provided with three connectors 21 which mate with the three connectors 20 on each of holders 12, 14 and 18, respectively, whereas the foot-end of duvet cover 44 is provided with six connectors 21 which mate with the six connectors 20 on holder 16.

With reference to FIGS. 2 and 3, it is assumed that the bed has been stripped of its pillows, duvet and sheet by service personnel, and that a pair of gripping panels 48*a* and 48*b*, the function of which will be described below, have been disengaged from the sides of the bed 10. The service personnel begin by attaching the mating connectors 21 on the edge of a fresh sheet 42 to the three connectors 20 (FIG. 1) on sheet holder 12. Similarly, the service personnel attach the mating connectors 21 on the edge of the head-end of the duvet cover 44 to the three connectors 20 on head-end duvet cover holder 14, and attach the six mating connectors 21 on the foot-end of the duvet cover 44 to the six connectors 29 on foot-end duvet cover holder 16. Finally, the service personnel attach the three mating connectors 21 on the duvet to the three connectors 20 on the duvet holder 18.

Figure 4:
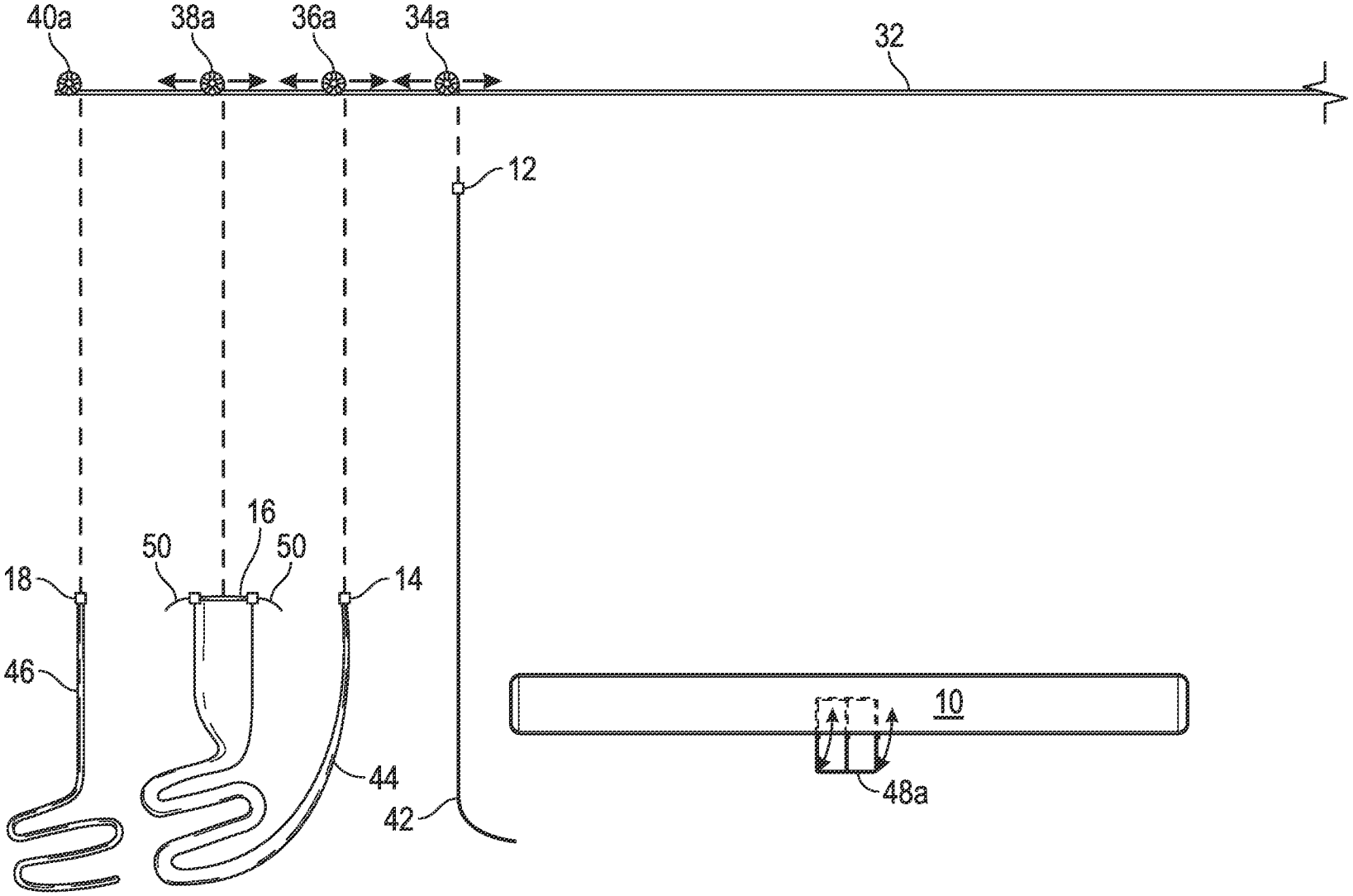

In FIG. 4, upper support rod 22 (FIG. 2) and associated pulleys 34*a* and 34*b* are rotated to thereby initially raise holder 12 and the sheet 42. It is preferable to then lower the sheet 42 after initially raising it, by reversing the rotation of rod 42, and then raising it again to the position shown in FIG. 4. The initial raising and lowering of the sheet ensure that any folds or kinks in the sheet 42 are straightened.

Figure 5:
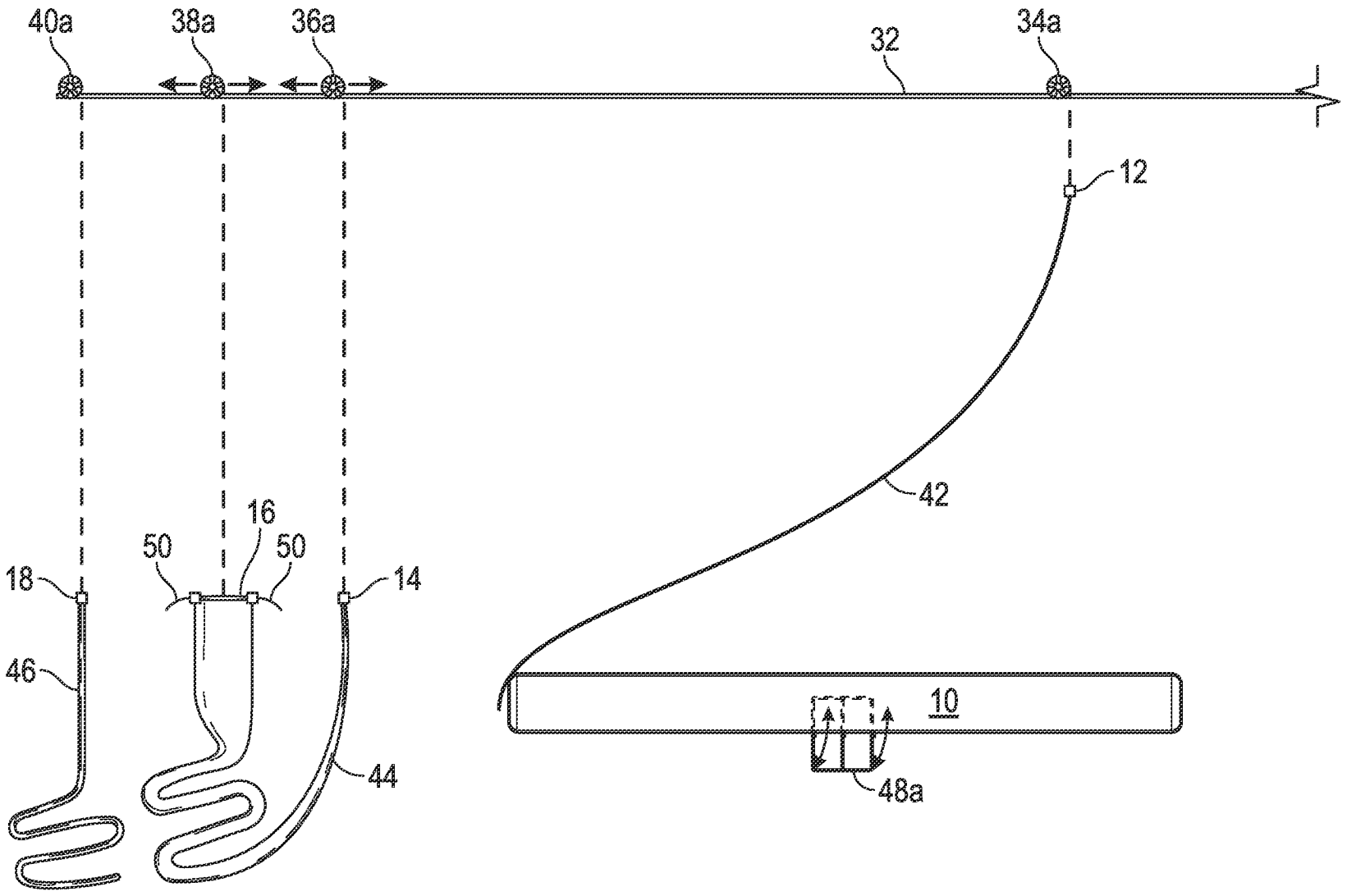
Figure 6:
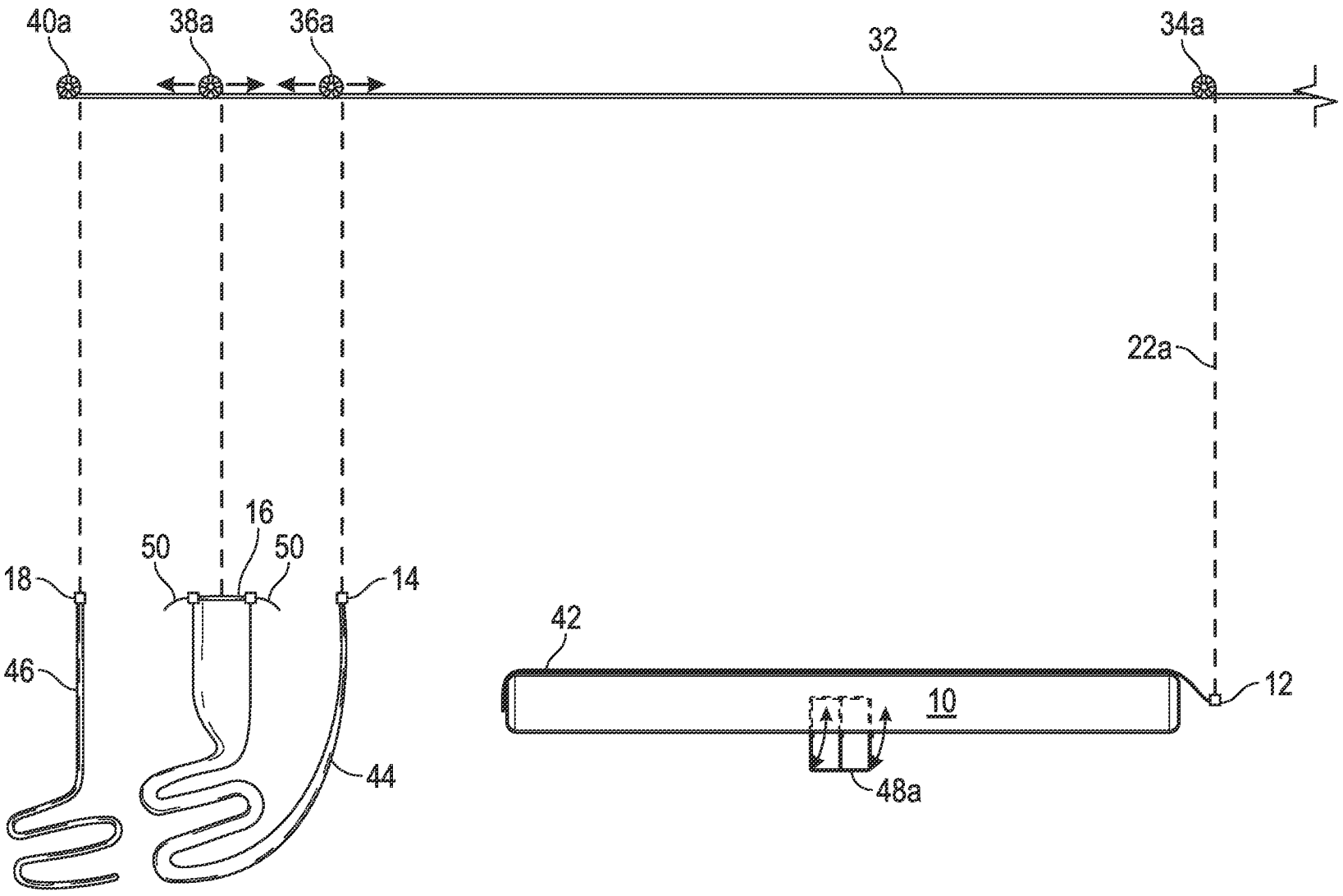

As shown in FIG. 5, upper support rod 22 (FIG. 2) and associated pulleys 34*a*, 34*b* are moved along tracks 30 and 32 toward the right, thereby pulling the leading edge of the sheet 42 over the bed 10. As shown in FIG. 6, upper support rod 22 and pulleys 34*a*, 34*b* are rotated to lower the holder 12 and leading edge of sheet 42 to cover the bed. At that point, the sheet 42 is fully covering the bed, the connectors 20 on the holder 12 disengage the mating connectors 21 on sheet 42 to thereby release the sheet from the holder, and gripping panels 48*a*, 48*b* rotate upwardly to snuggly secure the sheet to the sides of the bed. After releasing the sheet 42 from the holder 12, the upper support rod 22 can be rotated to retract the holder 12 upwardly as shown in FIG. 7.

Figure 7:
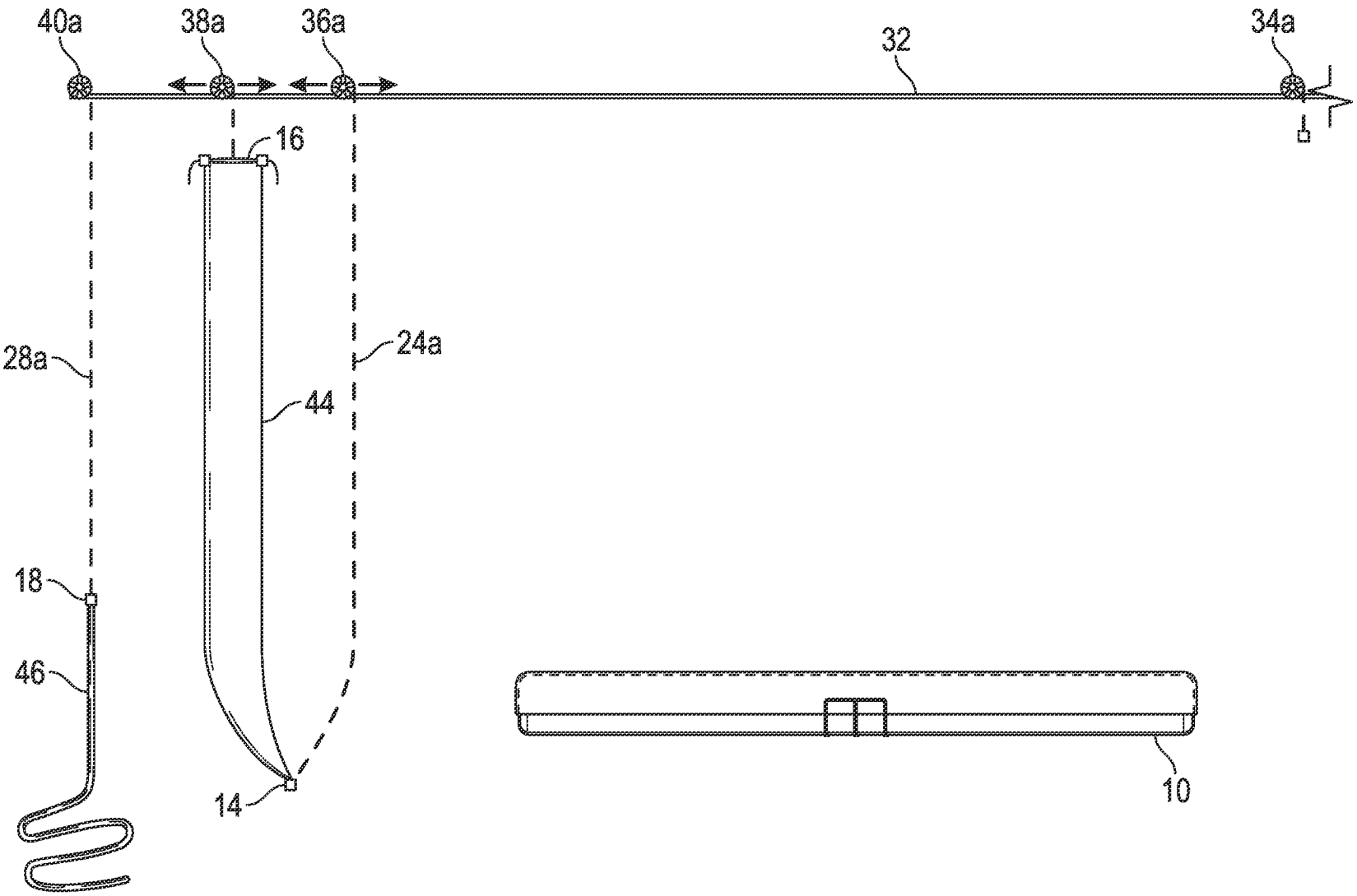
Figure 8:
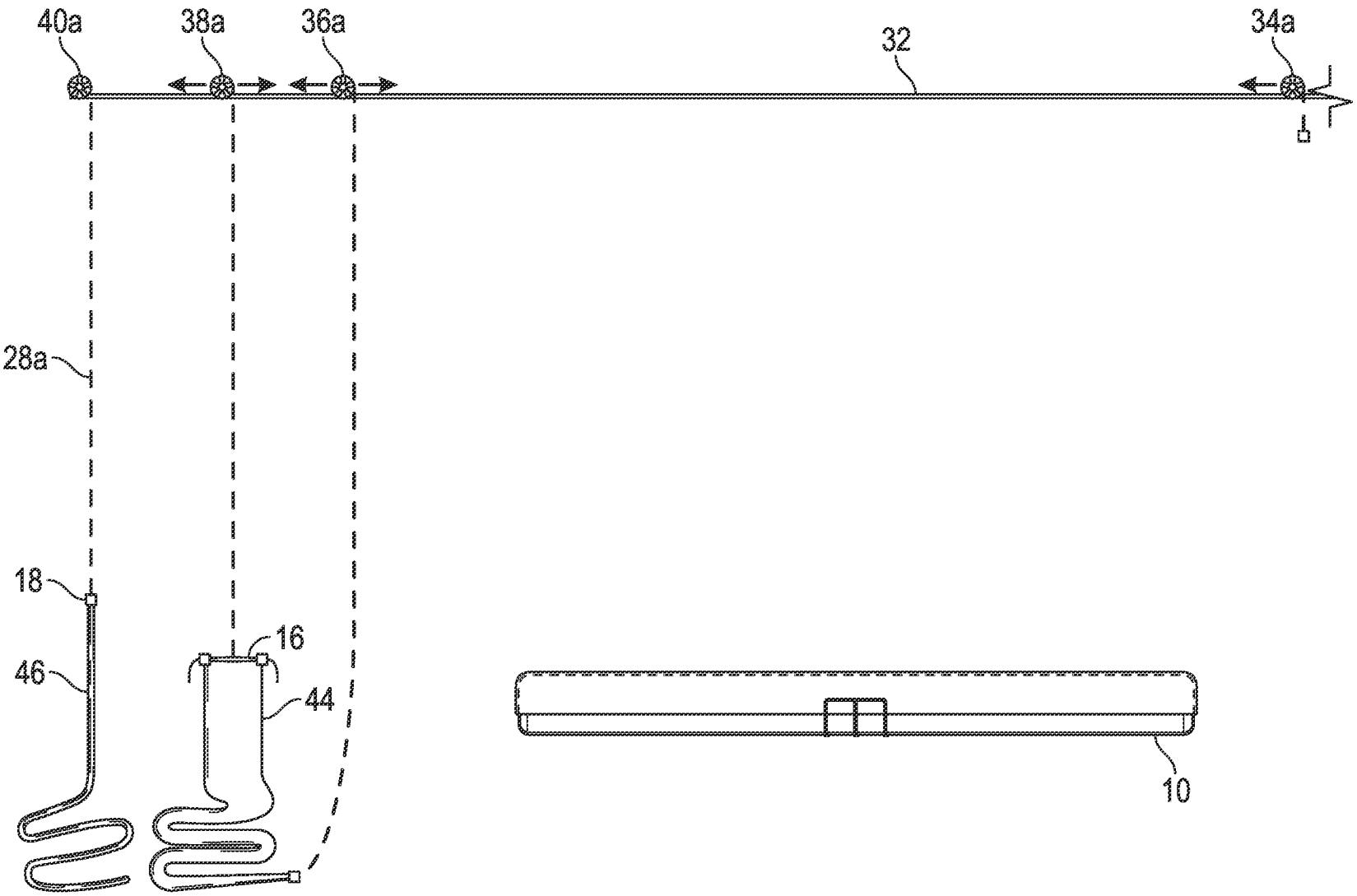
Figure 9:
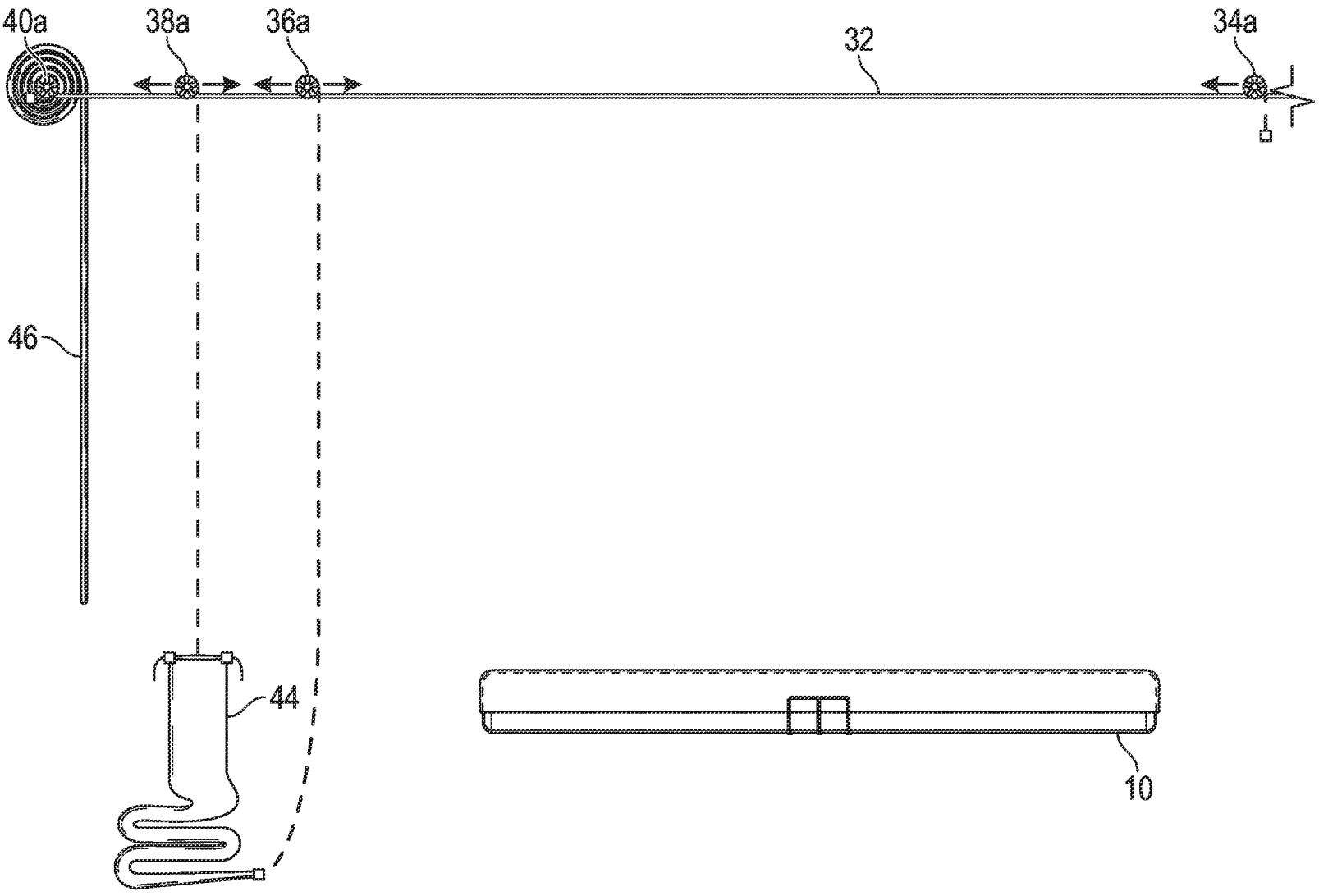
Figure 10:
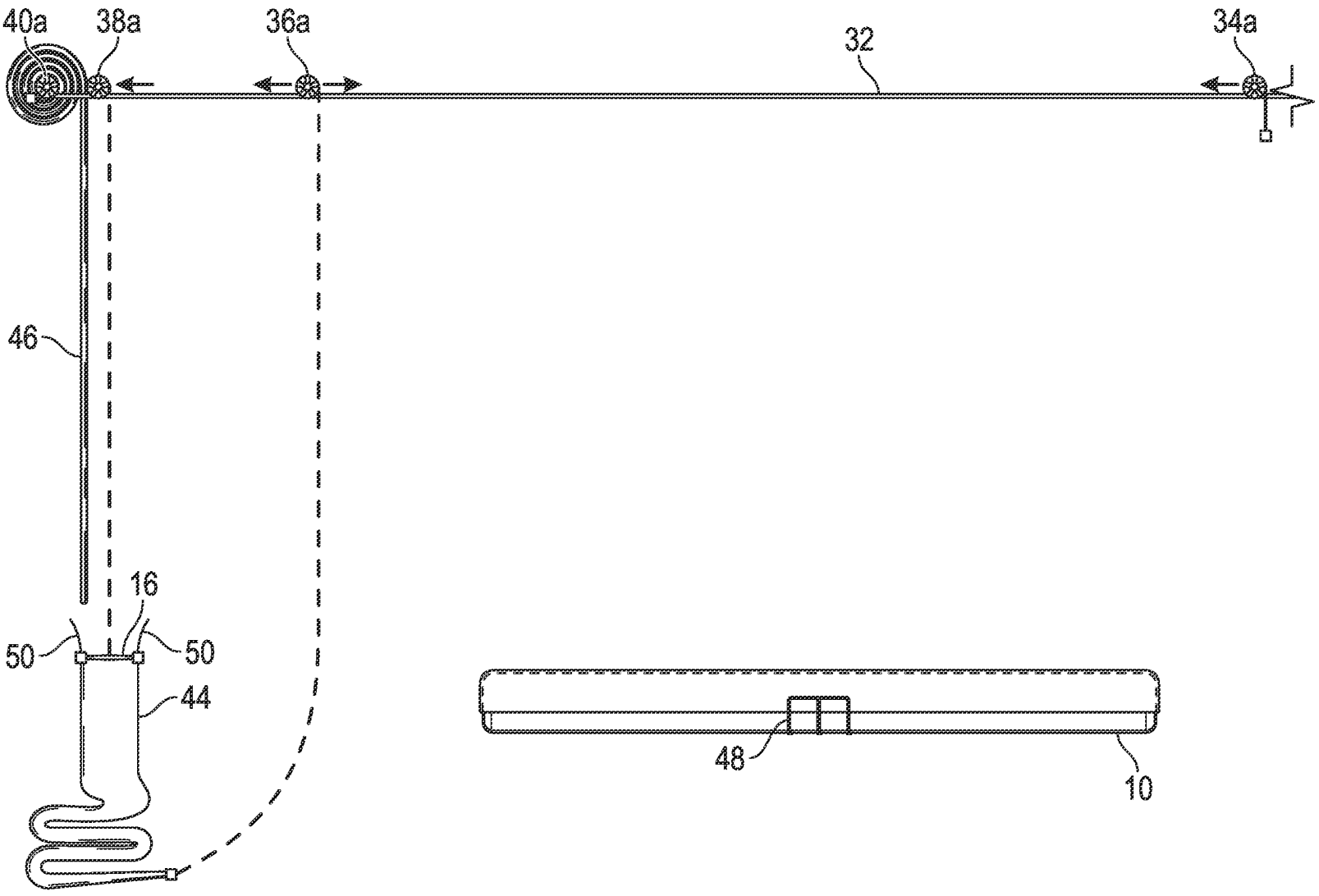
Figure 11:
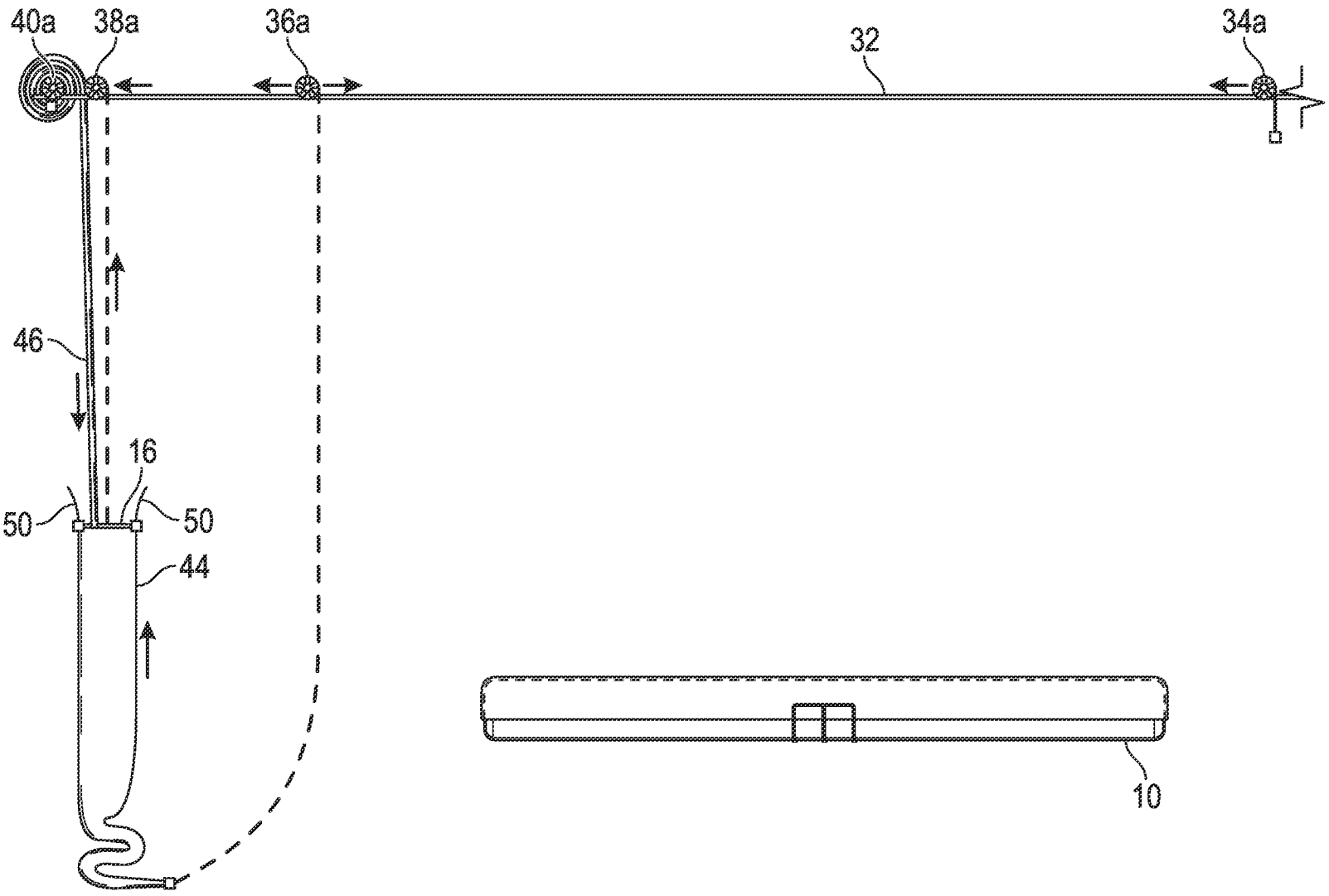
Figure 12:
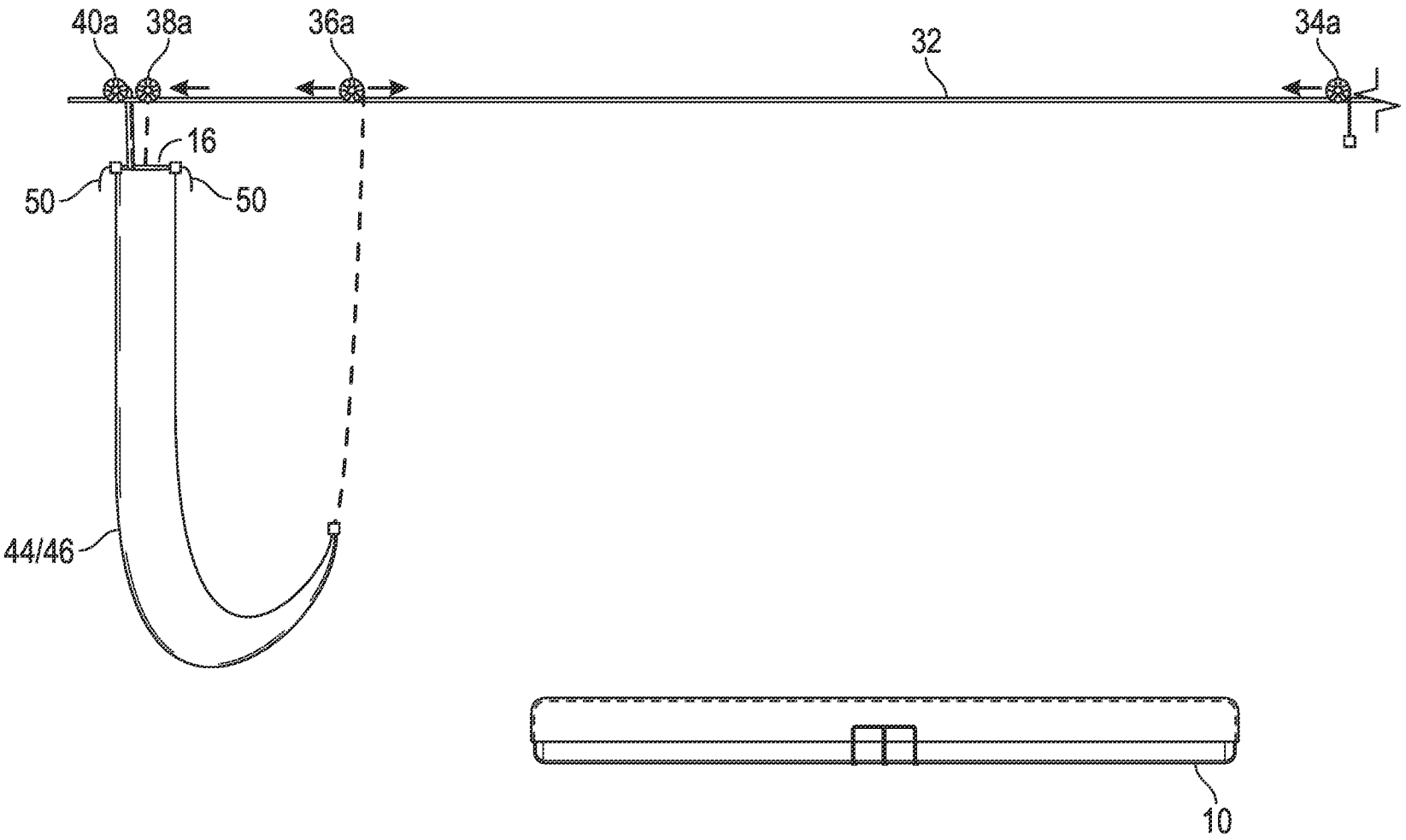

With further reference to FIGS. 7 and 2, support rod 24 and associated pulleys 36*a*, 36*b* are rotated to move holder 14 downwardly, and support rod 26 and associated pulleys 38*a*, 38*b* are rotated to move holder 16 upwardly as shown, to remove any unwanted folds or kinks in the duvet cover 44. Holder 16 is then lowered as shown in FIG. 8 by rotating support rod 26 and pulleys 38*a*, 38*b*. Upper support rod 28 and pulleys 40*a*, 40*b* are then rotated to lift holder 18 and duvet 46 and wrap the holder and duvet around upper support rod 28, to the position shown in FIG. 9. Support rod 26 and associated pulleys 38*a*, 38*b* are then moved on tracks 30 and 32 to the left as shown in FIG. 10, so that the opening of the duvet cover 44 is positioned underneath the end of the duvet 46. Alternatively, support rod 28 and associated pullies 40*a*, 40*b* can be moved to the right, so that the opening of the duvet cover 44 is positioned underneath the end of the duvet 46. At this point, a pair of generally planar guides 50 on holder 16 are actuated to move from a downwardly pointing orientation to an upwardly pointing orientation as shown in FIGS. 10 and 11, to assist in the insertion of the duvet into the cover. Then, in a series of intermittent step-wise movements, upper support rods 26 and 28 are rotated to move the duvet 46 down a few inches and then stop, then move duvet cover up a few inches and then stop. These steps—the intermittent lowering of the duvet and raising of the duvet cover—are repeated until the duvet is completely contained within the cover as shown in FIG. 12. These intermittent stepwise movements ensure that the duvet is inserted into the cover smoothly, without wrinkling or unwanted folding. Additionally, as shown in FIG. 1A, a vibratory transducer 52 is preferably attached to duvet cover holder 16. As the duvet is approaching the point where it is substantially contained within the cover, or at other selected times, the transducer can be actuated to further ensure that the duvet is positioned in the cover smoothly, without wrinkling or unwanted folding. After the duvet is fully contained within the cover, the guides 50 can be retracted as shown in FIG. 12.

Figure 13:
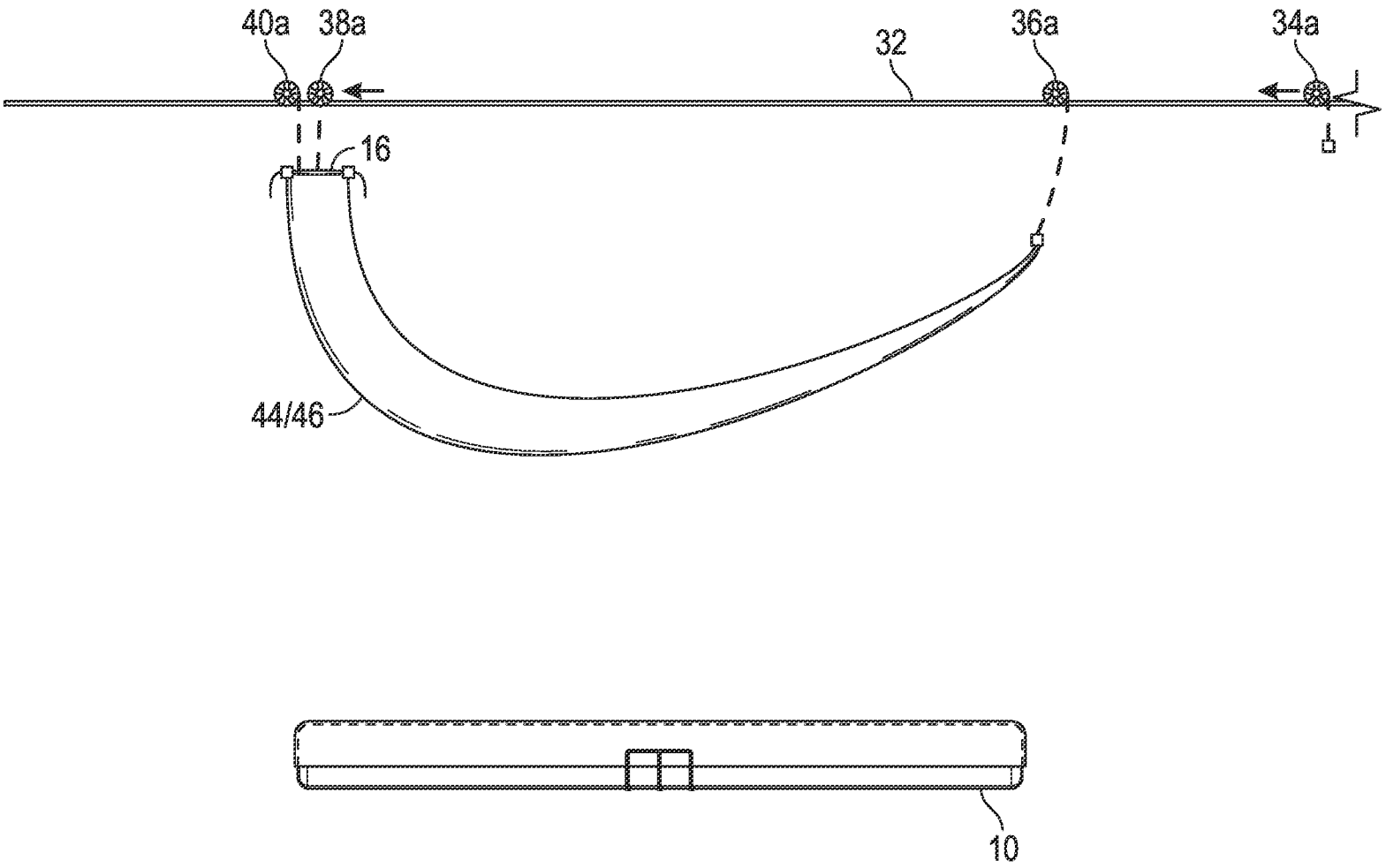
Figure 14:
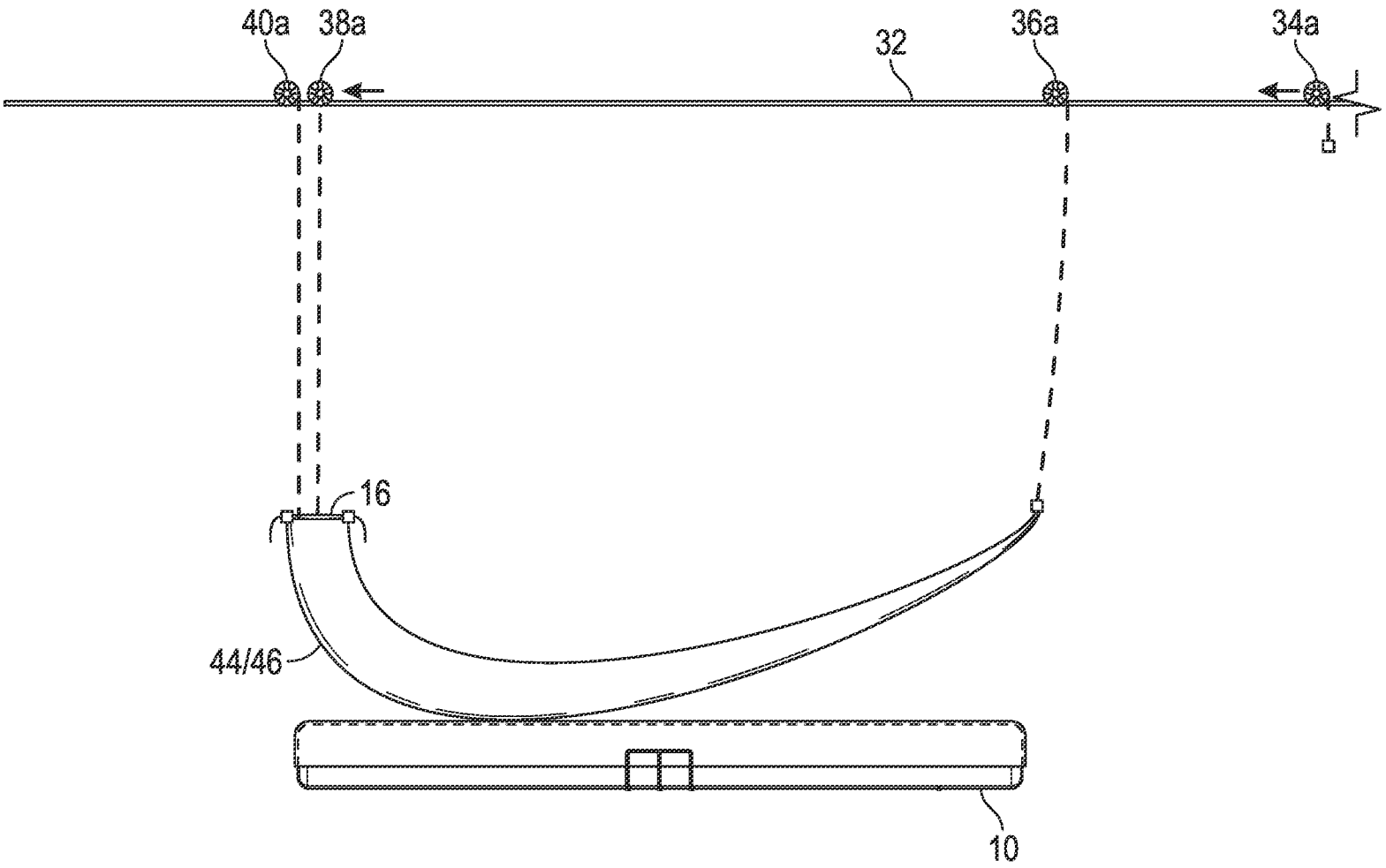
Figure 15:
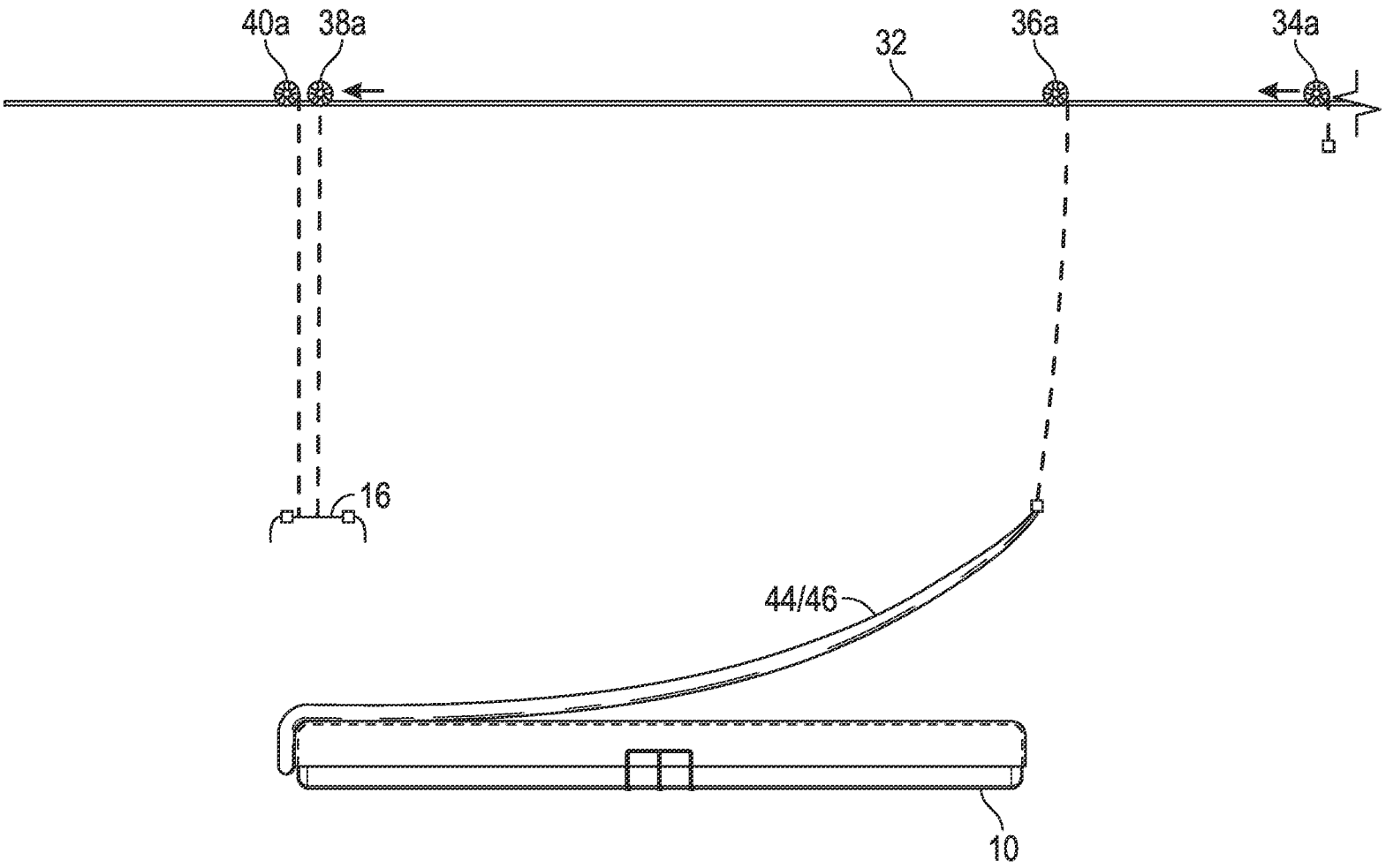
Figure 16:
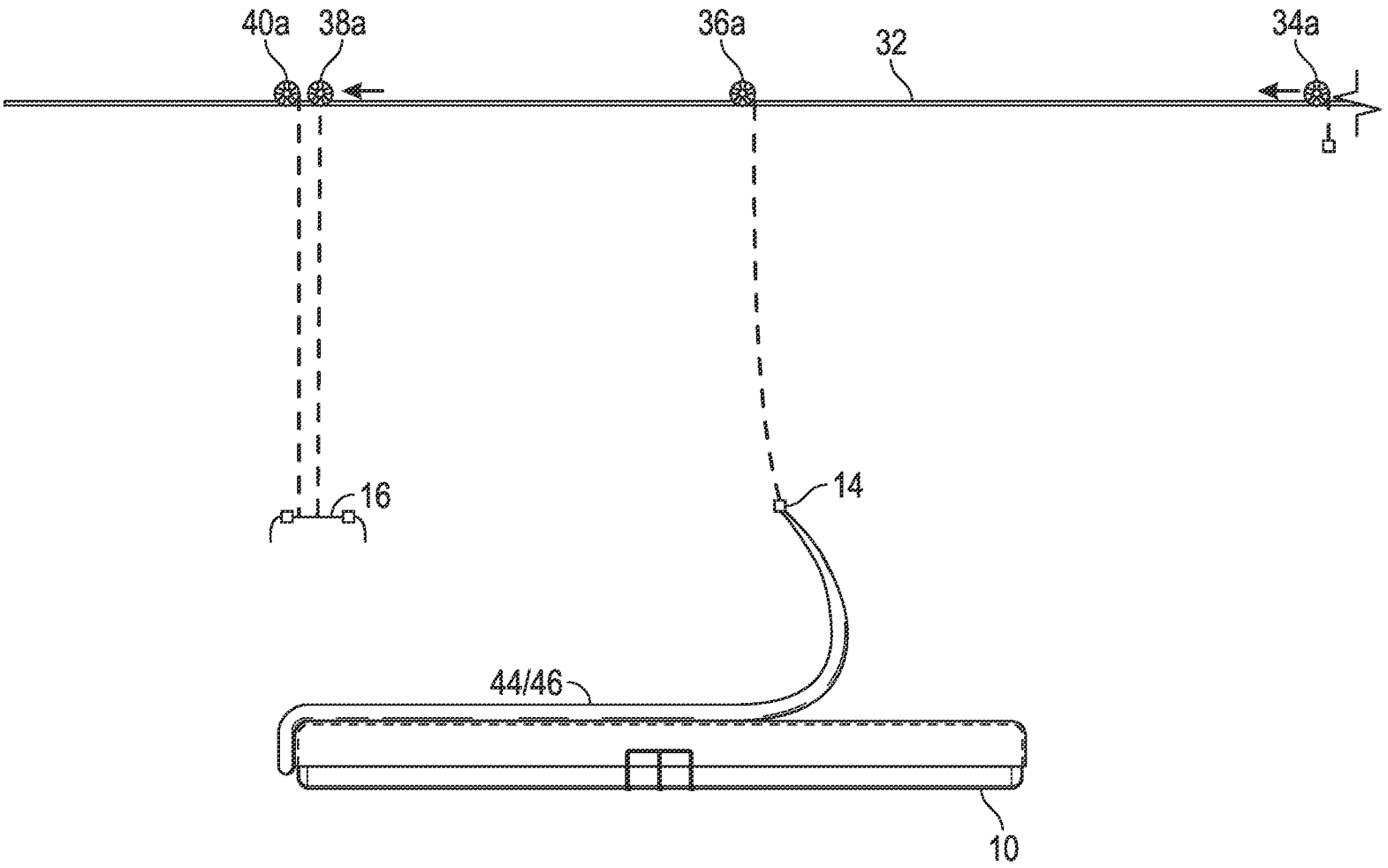
Figure 17:
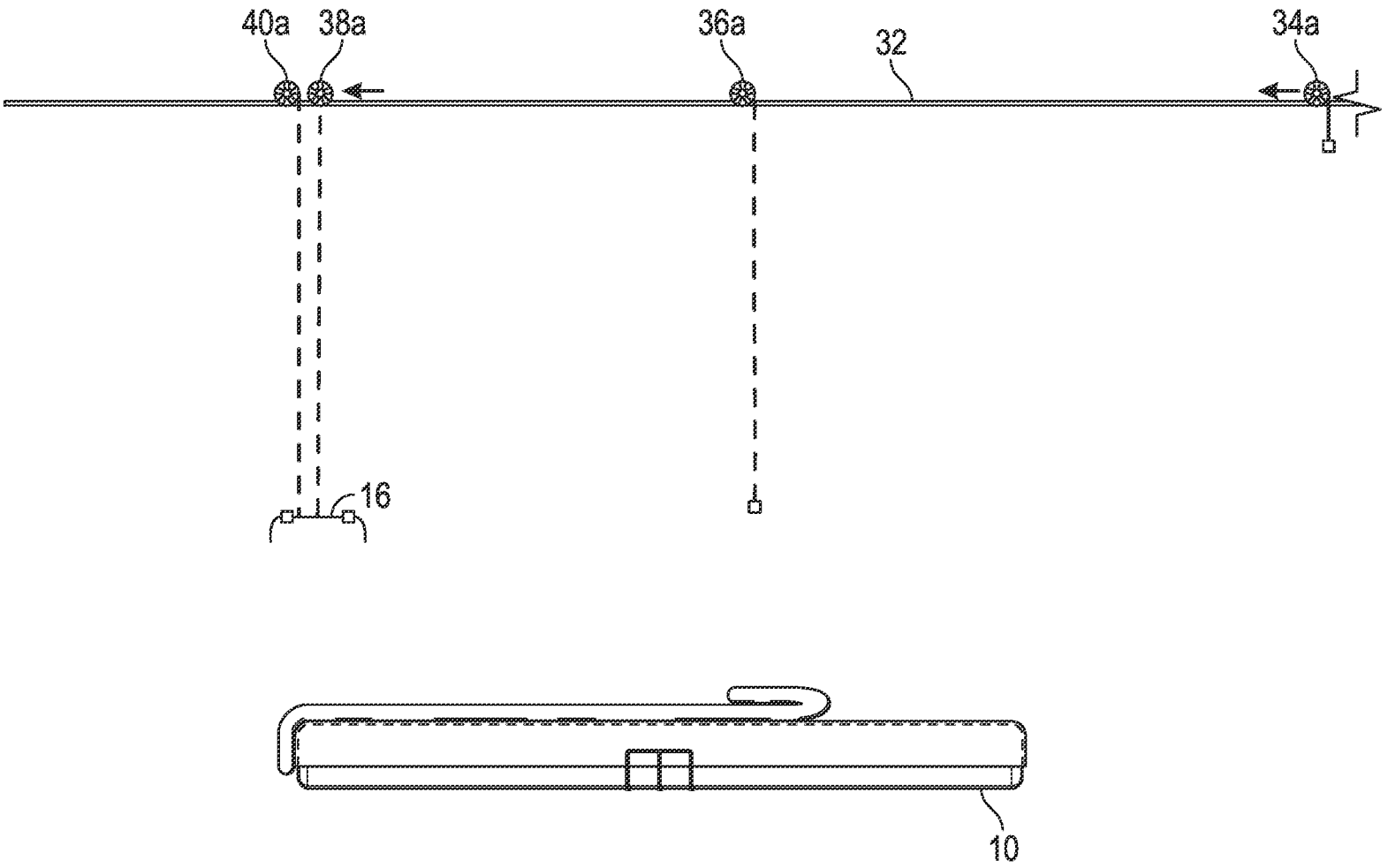

After the duvet is inserted into the cover, upper support rod 24 (FIG. 2) and pulleys 36*a*, 36*b* are rotated to move the head-end of the duvet 44 upwardly as shown in FIG. 12. Then, upper support rod 24 is moved on tracks 30, 32 to the right, to place the duvet substantially over the bed 10, as shown in FIG. 13. Then upper support rods 26 and 28 (FIG. 2) are rotated at the same time to move the foot-end of the duvet and the duvet cover downwardly together until the duvet touches the bed, as shown in FIG. 14. At this point, the duvet and duvet cover are released from holders 18 and 16, respectively, at the same time, to thereby drape the foot-end of the duvet over the end of the bed, as shown in FIG. 15. The upper support rod 24 (FIG. 2) is then moved slightly to the left so that the head-end of the duvet slightly overlaps itself as shown in FIG. 16. The holder 14 then releases the duvet cover, and the head-end of the duvet is aesthetically draped over itself, as shown in FIG. 17, to provide a spot for the manual placement of pillows on the bed.

At this point, the process is completed, and the upper support rods 22, 24, 26, 28 can be moved along tracks 30, 32 toward the left (or other location as desired), and rotated to lift the holders 12, 14, 16, 18 to retracted positions at or recessed into the ceiling.

It is noted that the various electromechanical devices described above can be readily implemented by those skilled in the art, using well-known, routine expedients such as motors, limit switches, rudimentary programmed control modules and the like.

The examples disclosed herein are for exemplary purposes only and should not be construed as limiting of present invention, which is defined in the following claims.

I claim:

1. Apparatus for automatically making a bed, comprising:

a) a sheet holder suspended from a sheet holder support;

b) a head-end duvet cover holder suspended from a head-end duvet cover holder support;

c) a foot-end duvet cover holder suspended from a foot-end duvet cover holder support, said foot-end duvet cover holder comprising a first framework formed of a plurality of rods defining a horizontally oriented opening;

d) a duvet holder suspended from a duvet holder support;

e) a plurality of connectors on each of said sheet holder, said head-end duvet cover holder, said foot-end duvet cover holder, and said duvet holder, said connectors adapted to be connected to mating connectors on a sheet, a head-end of a duvet cover, a foot end of said duvet cover, and a duvet, respectively; and f) a second framework upon which said sheet holder support, said head-end duvet cover holder support, said foot-end duvet cover holder support, and said duvet holder support are mounted.

2. The apparatus of claim 1 wherein at least said sheet holder support and said duvet holder support are adapted to selectively raise and lower said sheet and duvet, respectively.

3. The apparatus of claim 2 wherein at least said sheet holder support and said duvet holder support include pullies from which said sheet holder and duvet holder are suspended, respectively, to thereby raise and lower said sheet and duvet upon rotation of said pullies.

4. The apparatus of claim 2 wherein said head-end duvet cover holder support and said foot-end duvet cover holder support are adapted to selectively raise and lower said head-end duvet cover and said foot-end duvet cover.

5. The apparatus of claim 4 wherein said head-end duvet cover holder support and said foot-end duvet cover holder support include pullies from which said head-end duvet cover holder and said foot-end duvet cover holder are suspended, respectively, to thereby raise and lower said head-end and foot-end of said duvet upon rotation of said pullies.

6. The apparatus of claim 1 wherein said second framework is comprised of a track mounted on a ceiling in a room in which said bed is located, and at least said sheet holder support and said head-end duvet covert holder support are adapted to move along said track.

7. The apparatus of claim 1 wherein said connectors are electrically or electronically controlled.

8. The apparatus of claim 1 wherein at least one of said foot-end duvet cover holder support and said duvet cover support are adapted to move on said second framework relative to the other such that said opening can be positioned underneath an end of said duvet.

9. The apparatus of claim 8 further comprising guides attached to said foot-end duvet cover holder that are adapted to be engaged to facilitate the insertion of said duvet into said duvet cover.

10. The apparatus of claim 1 further comprising gripping panels on sides of said bed adapted to selectively grip said sheet against said sides and release said sheet from said sides.

11. The apparatus of claim 1 further comprising a vibratory transducer attached to said duvet cover holder.

12. The apparatus of claim 1 wherein said first framework is a unitary structure defining said opening.

13. The apparatus of claim 1 wherein said plurality of rods are formed of individual pieces connected to each other.

14. The apparatus of claim 1 wherein said plurality of rods are formed as a single unitary structure.

15. Apparatus for automatically making a bed, comprising:

a. a sheet holder suspended from a sheet holder support;

b. a head-end duvet cover holder suspended from a head-end duvet cover holder support;

c. a foot-end duvet cover holder suspended from a foot-end duvet cover holder support;

d. a duvet holder suspended from a duvet holder support;

e. a plurality of connectors on each of said sheet holder, said head-end duvet cover holder, said foot-end duvet cover holder, and said duvet holder, said connectors adapted to be connected to mating connectors on a sheet, a head-end of a duvet cover, a foot end of said duvet cover, and a duvet, respectively; and f. a framework upon which said sheet holder support, said head-end duvet cover holder support, said foot-end duvet cover holder support, and said duvet holder support are mounted, g. wherein said sheet holder, said head-end duvet cover holder and said duvet holder are comprised of rods, said foot-end duvet cover holder is formed of a plurality of rods to thereby define an opening, and wherein each of said rods is formed of metal, plastic or wood.

16. The apparatus of claim 15 wherein at least one of said foot-end duvet cover holder support and said duvet cover support are adapted to move on said framework relative to the other such that said opening can be positioned underneath an end of said duvet.

17. The apparatus of claim 16 further comprising guides attached to said foot-end duvet cover holder that are adapted to be engaged to facilitate the insertion of said duvet into said duvet cover.

* * * * *